United States Patent [19]

Yamamoto et al.

[11] Patent Number: 4,461,976

[45] Date of Patent: Jul. 24, 1984

[54] DISCHARGE LAMP STARTER

[75] Inventors: Minoru Yamamoto, Neyagawa; Koichiro Tanigawa, Katano; Kazunori Kubo, Moriguchi; Masazumi Takakura, Shijonawate, all of Japan

[73] Assignee: Matsushita Electric Works, Ltd., Osaka, Japan

[21] Appl. No.: 428,208

[22] Filed: Sep. 29, 1982

[30] Foreign Application Priority Data

Dec. 29, 1981 [JP] Japan ..... 56-214452

[51] Int. Cl.[3] ..... H05B 41/06

[52] U.S. Cl. ..... 315/100; 315/104; 315/290; 337/23

[58] Field of Search ..... 315/110-104, 315/290; 337/22-27, 104

[56] References Cited

U.S. PATENT DOCUMENTS 2,236,697 4/1941 Peters ..... 315/100 X
2,313,575 3/1943 Peters ..... 315/100
2,936,403 5/1960 Knobel ..... 315/100

FOREIGN PATENT DOCUMENTS 543171 1/1941 United Kingdom .

*Primary Examiner*—Eugene R. Laroche
*Attorney, Agent, or Firm*—Burns, Doane, Swecker & Mathis

[57] ABSTRACT

A discharge lamp starting device employing a thermal switch which comprises main and auxiliary bimetal electrodes respectively thermally bendable in the same direction, and an auxiliary heater for heating the auxiliary bimetal electrode in addition to a main heater for the main bimetal electrode. The auxiliary heater is energized to heat the auxiliary electrode upon a starting failure specifically when the discharge lamp is to be lighted again immediately after its extinguishment, whereby the auxiliary electrode is forced to bend toward the main electrode and a re-closing of the thermal switch and eventual lamp starting can be accelerated.

5 Claims, 13 Drawing Figures

DISCHARGE LAMP STARTER

This invention relates generally to discharge lamp starting devices and, more specifically, to a device capable of immediately starting and lighting discharge lamp.

As a most common discharge lamp starting means a glow starter has been used but, as has been well known, the lamp can be lighted only after several repetitions of contact opening and closing of the glow starter. Therefore, this type of starting devices involve problems that it takes a relatively long time to light the lamp and further an unpleasantness is given to the user due to flashings emitted several times by the starter.

In order to resolve the above problems, there has been suggested a so-called electronic starting device comprising such a semiconductor switching element as a thyristor, pulse transformer and the like. In this case, a quicker lighting of the discharge lamp can be realized but manufacturing costs become higher and the entire dimensions of the device become larger than in the case of the glow starter.

In order to realize an inexpensive and compact device, there has been also suggested in, for example, British Patent Specification No. 543,171 a discharge lamp starting device utilizing a bimetal as a movable contactor of a so-called thermal switch, wherein the thermal switch is opened after a preheating current is supplied to lamp filaments and a kick voltage is applied by a stabilizer to the lamp so as to light it. However, this device still has been insufficient for maintaining the immediate lighting ability specifically when the lamp is to be lighted again immediately after the lamp is once extinguished, only with such utilization of the thermal switch.

Accordingly, a primary object of the present invention is to provide a discharge lamp starting device which can maintain sufficiently the immediate lighting ability even immediately after an extinguishment of the discharge lamp and can light the lamp positively reliably.

Another object of the present invention is to provide a discharge lamp starting device employing a thermal switch including a pair of main and auxiliary bimetal electrodes capable of thermally bending the same direction, wherein an auxiliary heater for the auxiliary bimetal electrode is energized specifically upon a failure of starting again the discharge lamp lighting immediately after an extinguishment so that contact closing of the thermal switch can be accelerated and the startability is elevated, whereby the immediate lighting ability can be assured substantially in all operational modes of the device.

A further object of the present invention is to provide a discharge lamp starting device wherein such unpleasant repetition of flashings as in the case of glow starter can be prevented from occurring with an ability of lighting the lamp at a substantially single starting operation.

A still further object of the invention is to provide a discharge lamp starting device which can be made inexpensive and compact as compared with any known electronic starting device by effectively utilizing the thermal switch.

Other objects and advantages of the present inventions shall become clear from the following description of the invention detailed with reference to accompanying drawings, in which.

Figure 9A:
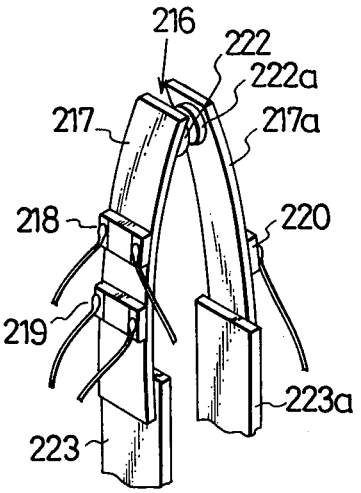
Figure 9B:
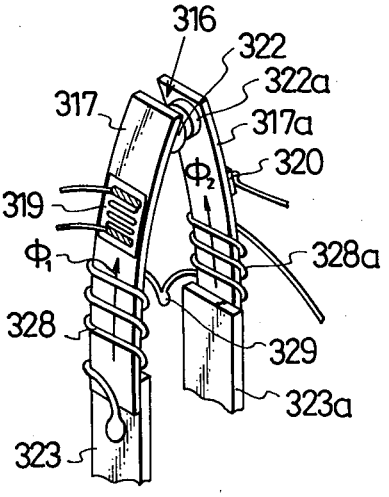

FIG. 9*a* is a fragmental perspective view as magnified in an aspect of a thermal switch employed in the starting device of the present invention;

FIG. 9*b* is a further fragmental perspective view as magnified in another aspect of the thermal switch different from that in FIG. 9*a;*

Figure 10:
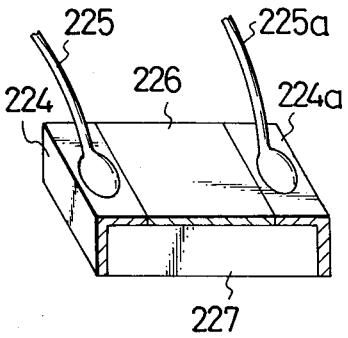
Figure 12:
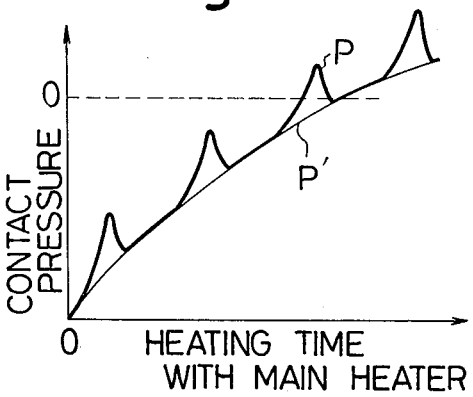
Figure 11:
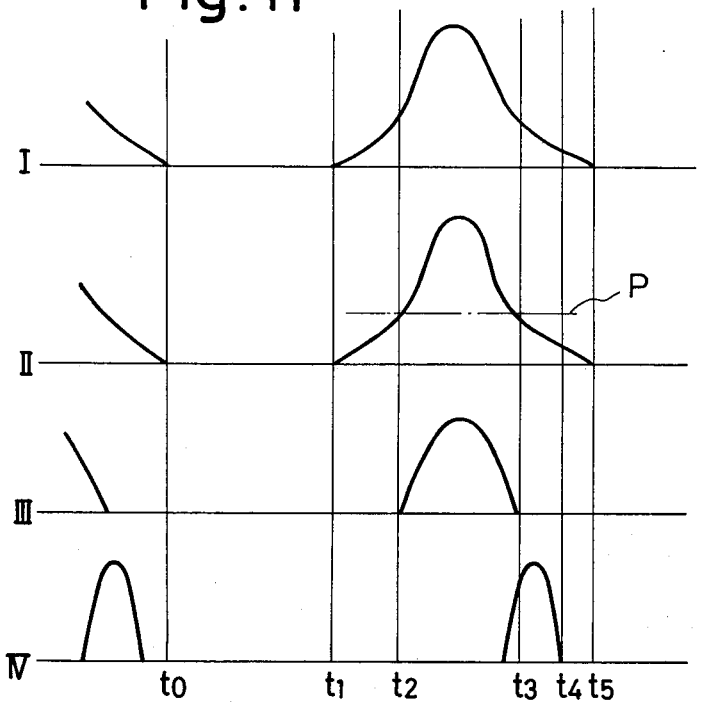

FIG. 10 is a fragmental perspective view as magnified in an aspect of a heater provided to the thermal switch of FIG. 9*a* or 9*b;* and FIGS. 11 and 12 show respectively a diagram for explaining the operation of contacts in the thermal switch in relation to a preheating current and a diagram showing variations in the contact pressure of the thermal switch, in the starting device according to the present invention.

While the present invention shall now be described with reference to certain preferred embodiments shown in the drawings, it should be understood that the intention is not to limit the invention only to those embodiments shown but rather to cover all alterations, modifications and equivalent arrangements possible within the scope of appended claims.

Figure 1:
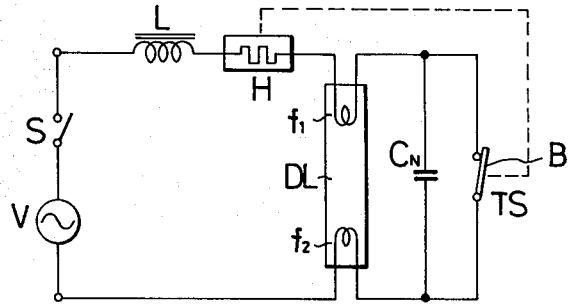
Fig. 1 (PRIOR ART)
FIG. 1 is a circuit diagram of a known discharge lamp starting device which employs a conventional thermal switch.

Prior to descriptions of the present invention, references shall first be made to a conventional discharge lamp starting device as shown in the drawings for better understanding of the invention. Referring to FIG. 1, a series circuit of a commercial power source V, source switch S, stabilizer L and heater H is inserted on the side of one of respective electrodes of filaments $f_1$ and $f_2$ of a discharge lamp DL, and power-supply side terminals of the filaments $f_1$ and $f_2$ are connected to the circuit. A parallel circuit of a noise suppressing capacitor $C_N$ and thermal switch TS is connected between non-power-supply side terminals of the filaments $f_1$ and $f_2$ so that a bimetal electrode B in the thermal switch TS is heated by the heater H. When the source switch S is turned on, a filament preheating current will flow through the filaments $f_1$ and $f_2$ and the non-power-supply side circuit thereof. Then, the bimetal electrode B in the thermal switch TS will be heated by the heater H in the power-supply side circuit of the filaments $f_1$ and $f_2$, the bimetal electrode B is thereby bent after a predetermined time and the thermal switch TS is opened. At the same time, a kick voltage induced by the stabilizer L in the power-supply side circuit is applied across the discharge lamp DL and the lamp is started to be lighted.

Under this condition, a discharge current will continue to flow through the power-supply side circuit and the heater H will continue to be heated, whereby the bimetal electrode is also kept in its bent state and the thermal switch remains in its open state. When, on the other hand, the source switch S is turned off, the power-supply to the power-supply side circuit is interrupted and the heater H is disenergized, whereby the bimetal B of the switch TS is cooled spontaneously to be returned to the initial closed position.

With this arrangement, however, it requires a relatively long time for the bimetal B to return to the closed position after the spontaneous cooling, the immediate lamp lighting can not be realized sufficiently as has been partly referred to in the foregoing in such event when, for example, the lamp is made to light immediately after the switch S has been turned off or its starting is failed.

The present invention has been suggested to remove the above problems and to accomplish the foregoing objects of the invention. According to a significant feature of the invention, a thermal switch having main and auxiliary bimetal electrodes respectively made to have the same bending direction is provided, and an auxiliary electrode heater provided in addition to a main electrode heater is positively energized for heating as required the auxiliary bimetal electrode so as to accelerate the closing operation of the thermal switch.

Figure 2:
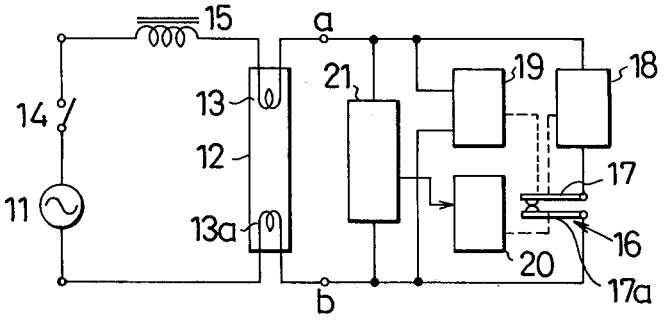
FIG. 2 is a circuit diagram, partly in block diagram, of a basic arrangement of the discharge lamp starting device according to the present invention.

FIG. 2 showing a basic example of circuit arrangement of the discharge lamp starting device of the present invention, a discharge lamp 12 is connected to a commercial power source 11, while a series circuit of a source switch 14 and stabilizer 15 including inductive current-limiting elements is inserted between power-supply side terminals of filaments 13 and 13*a* in the lamp 12, and thereby a power-supply side circuit is formed. On the other hand, to non-power-supply side terminals of the filaments 13 and 13*a*, normally closed thermal switch 16 including a main and auxiliary bimetal electrodes 17 and 17*a* is connected, a main heater 18 is connected between a non-power-supply side terminal a of the filament 13 and the main bimetal electrode 17 for being capable of heating this bimetal, while a holding heater 19 capable of also heating the main electrode 17 is connected in parallel to a series circuit of the main heater 18 and thermal switch 16 and between the non-power-supply side terminals a and b of the filaments 13 and 13*a*, and further a lighting discrimination circuit 21 capable of energizing an auxiliary heater 20 is connected in parallel to the series circuit of the main heater 18 and thermal switch 16 and also to the holding heater 19 and between the non-power-supply side terminals a and b.

The operation of the circuit of FIG. 2 shall be further detailed. When the switch 14 is turned on, a preheating current will flow through a filament preheating circuit formed by one of the terminals of the power source 11, switch 14, stabilizer 15, filament 13 of the discharge lamp, main heater 18, normally closed thermal switch 16 and the other filament 13*a*. This heating current causes also the main heater 18 to be energized, and thus the main bimetal electrode 17 starts to be heated. As the heating temperature rises, the main bimetal 17 bends in a direction of separating from the auxiliary bimetal electrode 17*a*, whereby the thermal switch 16 turns to its open state, upon which a kick voltage is induced by the inductance of the stabilizer 15 which including the inductive current-limiting elements and applied to the lamp 12, and thereby the lamp 12 is started to be lighted. While the lamp is being lighted, the supply of power is stopped to the main heater 18 but is maintained to the holding heater 19 which is parallel to the series circuit of the main heater 18 and thermal switch 16 so as to keep the main bimetal electrode 17 in the bent state, whereby the switch 16 is kept positively in the open state.

On the other hand, when the source switch 14 is in its ON state but the thermal switch 16 is in OFF state, that is, when the source switch 14 is turned on immediately after a distinguishment of the lamp or when the initial starting operation of the lamp has failed, such state is detected by the lighting discrimination circuit 21 and the auxiliary heater 20 is energized to cause the auxiliary bimetal electrode 17*a* to be heated and to be thus bent quickly toward the main bimetal electrode 17. As a result, even when the lamp is again made to be lighted shortly after being once extinguished, the thermal switch 16 is promptly closed to restore its initial state of performing the lighting operation, so as to assure positively the immediate lighting ability.

Figure 3:
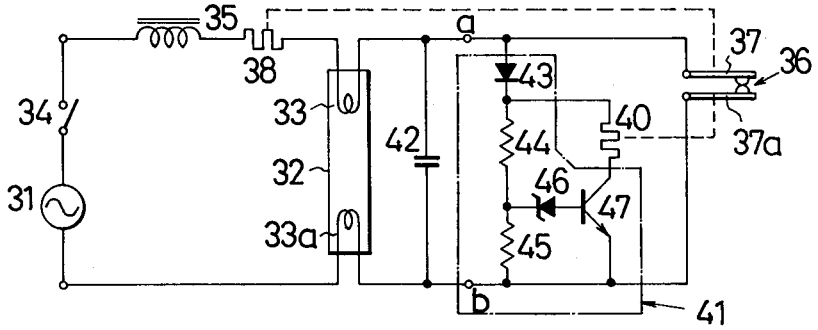
FIG. 3 shows a practical circuit arrangement in an embodiment of the discharge lamp starting device according to the present invention.

Referring further to a practical circuit arrangement in an embodiment according to the present invention as shown in FIG. 3, a main heater 38 is connected in series with a power source switch 34 and stabilizer 35 connected to a commercial power source 31 in a power-supply side circuit of filaments 33 and 33*a* of a discharge lamp 32 so that, when the source switch 34 is turned on, a main bimetal electrode 37 in a thermal switch 36 later detailed will be heated, the switch 36 will be thereby opened and this open state can be maintained. To non-power-supply side terminals of the filaments 33 and 33*a*, on the other hand, the thermal switch 36 which is similar to that of FIG. 2 is connected and, in parallel thereto, a lighting discrimination circuit 41 and auxiliary heater 40 are connected, while preferably a noise suppressing capacito 42 is also parallelly connected. The lighting discrimination circuit 41 includes a series circuit of a diode 43 and resistors 44 and 45 for dividing a voltage across the filaments 33 and 33*a*, and a transistor 47 is connected at the base through a contant-voltage diode 46 to a junction between the resistors 44 and 45. The transistor 47 is connected further at the collector to an end of an auxiliary heater 40 which is connected at the other end to a junction between the diode 43 and the resistor 44 and also thermally coupled to an auxiliary bimetal electrode 37*a* of the switch 36, while the emitter of transistor 47 is connected to a line between the auxiliary bimetal 37*a* and a non-power-supply side terminal b of the filament 33*a*. It will be readily appreciated to those skilled in the art that the discriminating circuit 41 in the present instance may be commonly used in FIG. 2.

Figure 4:
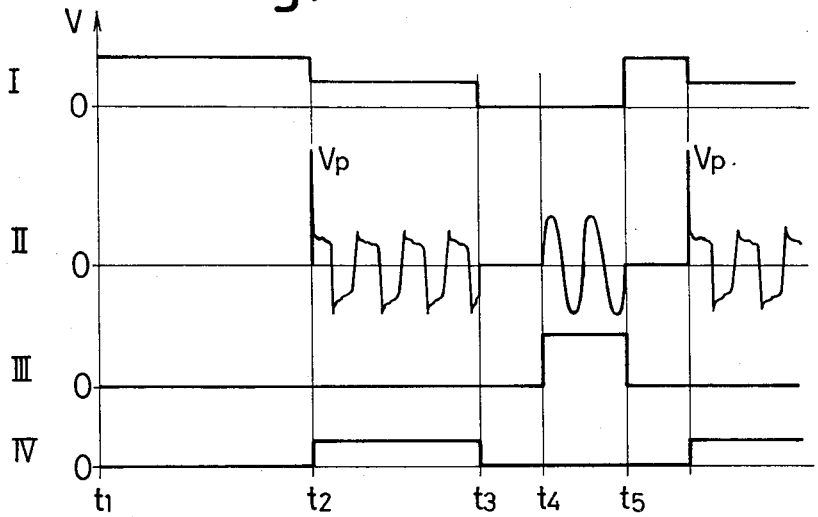
FIG. 4 shows waveforms for explaining the operating state of the circuit of FIG. 3.

The circuit of FIG. 3 operates substantially in the same manner as the circuit of FIG. 2 but, for a better understanding of the invention, the operation of the circuit of FIG. 3 shall be explained with reference to FIG. 4 from a point of view different from FIG. 2. Here, it should be apparent for those skilled in the art that, while FIG. 4 shows in II an instantaneous waveform, other waveforms I, II and IV are shown in the effective value. Now, when the source switch 34 is turned on at a time $t_1$ in FIG. 4, a preheating current will flow through a filament preheating circuit substantially similar to that in FIG. 2 and an effective voltage as shown in I of FIG. 4 is applied to the main heater 38 to energized the same so that the main bimetal electrode 37 of the thermal switch 36 is heated and bent, and the switch 36 is opened at a time $t_2$. At this time, no voltage is applied between the filaments 33 and 33*a* of the lamp 32 as seen in II of FIG. 4 since the thermal switch 36 is closed during a time period $t_1$–$t_2$ but, as soon as the switch 36 is opened at the time $t_2$, a kick voltage $V_p$ from the stabilizer 35 is applied between the filaments 33 and 33*a*, and the discharge lamp 32 is started to be lighted.

When the lamp 32 is thus lighted, a discharge current will flow substantially through the power-supply side circuit of the filaments 33 and 33*a*, to thereby maintain the energization of the main heater 38. Since, in the present instance, the discharge current is lower in the effective value than the preheating current, the main heater 38 is energized with a voltage lower than that during the time period $t_1$–$t_2$, as in the time period $t_2$–$t_3$ of I in FIG. 4, and the main bimetal electrode 37 will be held at the opened position. During the time period $t_2$–$t_3$, a voltage of such a waveform as shown in II of FIG. 4 is caused to appear across the non-power-supply side terminals a and b of the filaments 33 and 33*a*, but the transistor 47 will not be turned on so as not to energize the auxiliary heater 40 because a voltage applied through the voltage dividing resistors 44 and 45 to the constant-voltage diode 46 is lower than the Zener voltage thereof.

A time period $t_3$–$t_4$ in FIG. 4 indicates the state in which the source switch 34 is turned off. Now, as is made clear in FIG. 4, it is assumed here that after the discharge lamp is lighted in the period $t_2$–$t_3$ the source switch 34 is temporarily turned off and is again turned on at a time $t_4$. In an event when this duration $t_3$–$t_4$ is very short, i.e., if the lamp is made to light again promptly after being extinguished, then the main bimetal electrode 37 starts to return to the original position in a manner close to the spontaneous cooling so as to approach the auxiliary bimetal electrode 37*a* (since the current flowing from the source to the path of the main heater 38, diode 43, auxiliary heater 40 and transistor 47 becomes extremely small specifically due to a large resistance value of the auxiliary heater 40 and thus the main bimetal electrode 37 can not be heated substantially) but, with this operation alone, the thermal switch 36 is not made to close immediately. Under this condition, on the other hand, the thermal switch 36 being thus opened does not allow the preheating current to flow and the lamp thus not started also does not cause any discharge current to flow. Accordingly a source voltage higher than that during the time period $t_2$–$t_3$ is applied to the non-power-supply side terminals a and b of the filaments 33 and 33*a* during a time period $t_4$–$t_5$ as seen in II of FIG. 4. As a result, a voltage applied through the voltage-dividing resistors 44 and 45 to the constant-voltage diode 46 becomes larger than the Zener voltage and, during the time period $t_4$–$t_5$ or, more specifically, during each half cycle of the source current in which the voltage across the resistor 45 exceeds the Zener voltage of the contant-voltage diode 46, the transistor 47 is turned on, and such effective voltage as shown in III of FIG. 4 is applied to the auxiliary heater 40 during the same period to energize this heater. The auxiliary bimetal electrode 37*a* is thereby heated and bent in the same direction as the main bimetal 37 to quickly narrow the gap between the both bimetals 37 and 37*a* and, when the time $t_5$ is reached, the switch 36 is immediately closed, upon which the circuit operates substantially in the same manner as in the time period $t_1$–$t_3$ to light the lamp 32.

Even when the lighting operation ends unsuccessful at, for example, the time $t_2$, substantially the same operation as in the duration $t_4$ to $t_5$ is performed so that the immediate lighting ability can be well assured at all events. On the other hand, in the case where the holding heater is independently provided for the main heater as in the circuit of FIG. 2, the waveform present in the duration $t_2$–$t_3$ of I in FIG. 4 will not appear but, instead, a voltage of such waveform as in IV of FIG. 4 energizes the holding heater to heat the main bimetal electrode.

Figure 5:
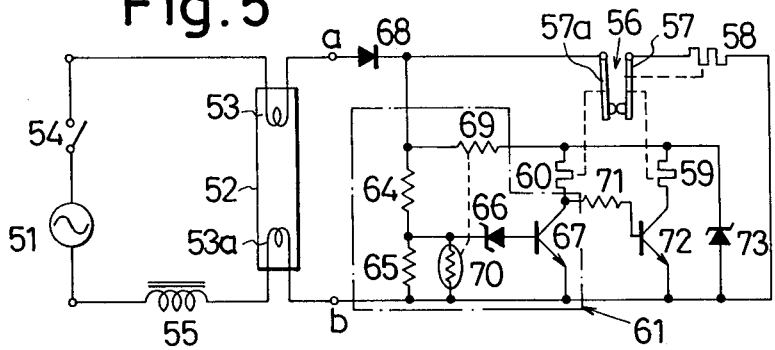
FIG. 5 shows a practical circuit arrangement in another embodiment of the starting device according to the present invention.

According to another feature of the present invention, the immediate lighting ability can be further improved by increasing preheating current. Referring to FIG. 5, a source switch 54 and stabilizer 55 are inserted respectively between a power source 51 and each of power-supply side terminals of filaments 53 and 53*a* of a discharge lamp 52, while a series circuit of a diode 68, thermal switch 56 and main heater 58 is connected between non-power-supply side terminals a and b of the filaments 53 and 53*a*, so that the diode 68 will be connected at its cathode with an auxiliary bimetal electrode 57*a* of the thermal switch 56 and the main heater 58 will be connected to a main bimetal electrode 57 as thermally coupled thereto. Further, a lighting discrimination circuit 61 connected in parallel to the thermal switch 56 is additionally provided with a resistor 69 connected at an end to an auxiliary heater 60 connected to the collector of a transistor 67 and at the other end to a connection line between the diode 68 and a voltage-dividing resistor 64, and with such heat-sensitive element 70 as, preferably, a negative characteristic thermistor inserted in parallel to another voltage-dividing resistor 65 as connected at one end to a connection line between a junction of the both resistors 64 and 65 and a constant-voltage diode 66 and as thermally coupled to the resistor 69. The collector of the transistor 67 is also connected through a resistor 71 to the base of a transistor 72 which is connected at the collector to a holding heater 59 connected at an end to a junction of the auxiliary heater 60 with the resistor 69, and another constant-voltage diode 73 is connected in parallel to a series circuit of the holding heater 59 and transistor 72.

In the embodiment shown in FIG. 5, the lamp starting operation during the time period $t_1$–$t_3$ in FIG. 4 is substantially similar to that in the embodiment of FIG. 3 but is different therefrom in that, since the diode 68 is inserted specifically in the filament preheating circuit, the stabilizer 55 is caused to be excited by a rectified current so that the current limiting performance of the stabilizer will be reduced. As a result, the preheating current becomes larger as compared with the case where the preheating is performed with the positive and negative waveforms as in the circuit of, for example, FIG. 3, whereby the preheating of the filaments can be accelerated and the lamp starting time required can be shortened. Further in the present instance, substantially the same operation of the lighting discrimination circuit as that during the period $t_4$–$t_5$ in FIG. 4 of the embodiment of FIG. 3 is performed, except that, since the transistor 67 is made off during the lamp lighting, the collector of the transistor 67 is at a high level so that a base current will flow through the resistor 71 to the transistor 72 to turn it on, whereby the holding heater 59 is energized and the main bimetal 57 is held in the open state. While in the case of FIG. 3 a single heater is employed so as to act as both of the main and auxiliary heaters and the heating capacity of the holding heater is not made to be constant, the holding heater 59 is provided separately from the main heater 58 in the present embodiment, so that the resistor 69 and the constant-voltage diode 73 will be effective to render the holding and auxiliary heaters 59 and 60 both to be of a constant voltage, whereby they can energized with a substantially the same level voltage without being affected by fluctuations in the source voltage or in the lamp voltage due to variations in the ambient temperature, thus the gap between the main and auxiliary bimetal electrodes 57 and 57*a* will not vary and eventually the required time for re-starting the discharge lamp can be stabilized. In an event when the lamp 52 falls in non-lighting condition due to its expiration of service life, further, at least the starting operation is caused to be effected during, for example, the period $t_4$–$t_5$ in FIG. 4 but, when this state continues and a predetermined time has elapsed, the resistance value of the heat-sensitive element 70 heated through the resistor 69 will be lowered. Therefore, the effective resistance value across the resistor 65 will be made smaller whereas the voltage dividing ratio of the resistors 64 and 65 will become higher so that, even if the source voltage is applied between the non-power-supply side terminals a and b in the state of this non-lighting condition, the transistor 67 will not be turned on and the transistor 72 alone will be always turned on, whereby the holding heater 59 will continue to be energized to hold the thermal switch 56 as opened. As a result, there are obtained such effects that any wear and damage of the thermal switch contacts can, be effectively prevented, the power consumption can be minimized and so on.

Figure 6:
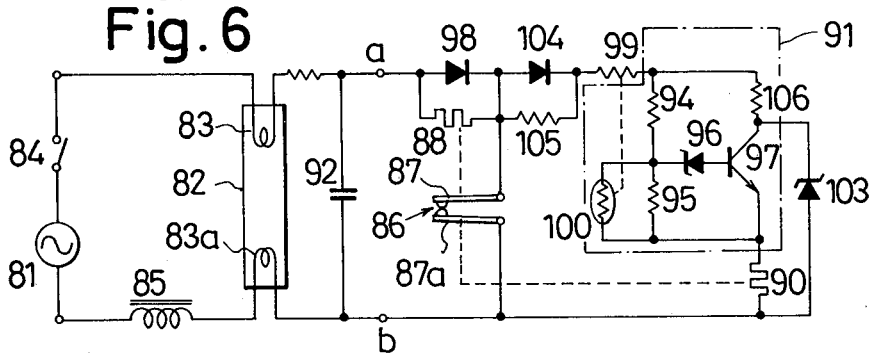
FIGS. 6 and 7 show respectively a further practical circuit arrangement in further different embodiments of the starting device according to the present invention.

According to a further feature of the present invention, the bimetal electrode gap in the thermal switch can be kept substantially constant and the immediate lamp lighting ability can be well assured, even if the ambient temperature around the lamp varies. Referring to FIG. 6, a power-supply side circuit of a discharge lamp 82 is the same as that in FIG. 5. To the non-power-supply side terminals a and b of the lamp 82, a thermal switch 86 is connected through a resistor for controlling the preheating current in parallel to a noise suppressing capacitor 92, and a parallel circuit of a diode 98 and main heater 88 for heating a main bimetal electrode 87 is connected between the terminal a and the main bimetal 87. Further, a lighting discrimination circuit 91 is connected in parallel to the thermal switch 86 through a parallel circuit of a diode 104 and resistor 105 as well as a resistor 99 for regulating the holding power. A transistor 97 in the discrimination circuit 91 is connected at the base to a circuit of voltage-dividing resistors 94 and 95 and constant-voltage diode 96, at the collector through a resistor 106 to a junction of the voltage-dividing resistor 94 to the resistor 99 and at the emitter to an auxiliary heater 90 for heating an auxiliary bimetal 87*a*. A heat-sensitive element 100 is connected in parallel to the other voltage-dividing resistor 95, and a constant-voltage diode 103 is connected in parallel to the transistor 97 and auxiliary heater 90.

Also in the embodiment shown in FIG. 6, the same starting operation as that in the embodiment of FIG. 3 during the period $t_1$–$t_3$ of FIG. 4 is carried out and, in addition, when a source switch 84 is turned on and a source voltage from a commercial power source 81 is applied, a preheating current which is half-wave rectified by the diode 98 will flow through the diode 98 and a preheating circuit of the main heater 88 and normally-closed thermal switch 86 on the non-power-supply side, whereby the starting time can be reduced in the same manner as in the circuit of FIG. 5. In the present instance of FIG. 6, the operation of the lighting discrimination circuit during the period $t_4$–$t_5$ in FIG. 4 is similar to that in the embodiment of FIG. 5. That is, when the switch 86 is being closed in the non-lighting condition of the lamp, a voltage exceeding a Zener voltage of the diode 96 is applied to the transistor 97 to turn it on and the auxiliary heater 90 is energized to heat the auxiliary bimetal 87*a*. After the switch 86 is opened and the lamp 82 is lighted, the main heater 88 is energized with negative half cycles of such discharge lamp voltage as in II of FIG. 4 supplied through a path of the terminal b, diode 103 and resistors 106, 99 and 105 between the non-power-supply side terminals a and b of the filaments 83 and 83*a*, whereby the main bimetal 87 can be held in the open state without using any separate holding heater.

Figure 8:
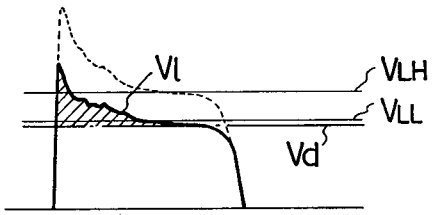
FIG. 8 is a diagram showing relations between a voltage applied to the discharge lamp and a Zener voltage.

A unique operation in the circuit of FIG. 6 shall now be detailed. Generally a voltage $V_L$ between the filaments of a discharge lamp being lighted is low when the ambient temperature is high but is high when the temperature is low. On the other hand, the amount of heat generated by the main heater 88 depends upon the lamp voltage $V_L$ and is proportional to the square of $V_L$. Thus, when $V_L$ is large, the main bimetal 87 is bent to a large extent, whereby the gap between the main and auxiliary bimetal electrodes 87 and 87*a* will be made larger whereas, if $V_L$ is small, the bimetal gap cannot be made sufficient. Therefore, in the former case, the restarting requires a longer time whereas, in the latter case, the thermal switch can not be maintained in the open state during the lighting so as to render the lighting to be impossible. In an event when, at this time, the voltage between the junction of the resistors 94 and 99 and the emitter of the transistor 97 becomes higher than the Zener voltage of the constant-voltage diode 96 even after being divided by the resistors 94 and 95 in the lighting discrimination circuit 91 including the diode 96, the transistor 97 is made on to energize the auxiliary heater 90. It will be also appreciated that the collector current of the transistor 97 will increase until the above voltage between the junction and the emitter drops to the level of the Zener voltage but, when the particular voltage drops further, the base current is caused to decrease and thereby this voltage is made constant. If, therefore, this constant voltage value $V_D$ is set to be close to the lowest effective value $V_{LL}$ of the discharge lamp voltage $V_L$ as shown in FIG. 8, the transistor 97 will be in off state so long as the ambient temperature is high and $V_L$ is decreased to $V_{LL}$, and the auxiliary heater 90 will not be energized. On the contrary, if the lamp voltage $V_L$ becomes high, the main heater 88 is energized and the main bimetal electrode 87 is bent to a relatively large extent, but a relatively small voltage $V_L$–$V_D$ is also applied to the auxiliary heater 90 to energize it, the auxiliary bimetal electrode 87*a* is also bent in the same direction as the main electrode 87 so as to maintain the bimetal gap to be substantially constant. When the ambient temperature becomes further low and the lamp voltage $V_L$ approaches the highest value $V_{LH}$, the main bimetal electrode 87 will be bent to a considerably large extent, but a relatively large voltage $V_{LH}$–$V_D$ is also applied to the auxiliary heater 90, whereby the auxiliary bimetal electrodes 87*a* will be also bent so as to maintain the bimetal gap to be contant and the sufficient gap is assured.

Whereas in the foregoing embodiment of FIG. 5 the auxiliary bimetal electrode is made to bent so as to "meet" the main bimetal electrode restoring as spontaneously cooled since the main and holding heaters are both deenergized upon the re-lighting immediately after a distinguishment or upon the starting failure of the discharge lamp, the auxiliary bimetal electrode in the present embodiment of FIG. 6 is made to bend quickly so as to "chase" the main bimetal electrode to close again the thermal switch while the main bimetal electrode is also made to bend by the main heater 88 which is energized through a constant-voltage diode 103 and resistors 106, 99 and 105 upon the similar occasions, whereby the immediate lamp lighting ability can be sufficiently maintained similarly to the case of FIG. 5.

Also in the circuit of FIG. 6, the resistor 99 and heat-sensitive element 100 can realize the function obtained by the resistor 69 and heat-sensitive element 70 in the circuit of FIG. 5.

Figure 7:
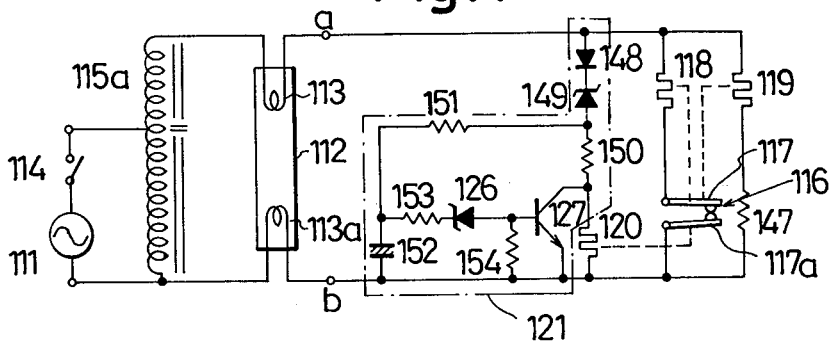

According to still another feature of the present invention, an arrangement is provided so that, when the discharge lamp reaches the final state of its service life, the starting operation can be stopped positively reliably. Referring to FIG. 7, a leakage transformer type stabilizer 115*a* is connected through a source switch 114 to a commercial power source 111 on a power supply side of filaments 113 and 113*a* in a discharge lamp 112. On the other hand, a series circuit of a main heater 118 and thermal switch 116 is connected between non-power-supply side terminals a and b and, in parallel to this series circuit, another series circuit of a holding heater 119 and resistor 147 and a lighting discrimination circuit 121 are connected. A transistor 127 in this lighting discrimination circuit 121 is connected at the collector to a junction of an auxiliary heater 120 with a resistor 150 which is connected at an end to the terminal a through a diode 148 and constant-voltage diode 149 and at the base to a junction of a resistor 151 with a capacitor 152 through a constant-voltage diode 126 and resistor 153, and a resistor 154 is connected between the base and the emitter.

In this circuit of FIG. 7, the starting operation during the time period $t_1$ to $t_3$ is the same as that in the foregoing embodiments and, when the Zener voltage of the diode 148 is set to be a value $V_{DL}$ close to the lowest effective value $V_{LL}$ of the discharge lamp voltage, it is possible to regulate the heating capacity of the auxiliary heater with respect to fluctuations in the lamp voltage for maintaining the bimetal gap to the constant, as in the case of FIG. 6. Upon a re-starting of the lamp lighting, an auxiliary bimetal electrode 117*a* heated by the auxiliary heater 120 can be made to properly "chase" a main bimetal electrode 117 heated by the main heater 118. When the lamp reaches the end of its service life and becomes difficult to be lighted and a voltage between the non-power-supply side terminals a and b is made to rise, the capacitor 152 is charged through the resistor 151 so that, after a fixed time, a voltage across the capacitor 152 increases to exceed the Zener voltage of the constant-voltage diode 126, and the transistor 127 is turned on. Consequently, a bypass circuit for the auxiliary heater 120 is completed so that the auxiliary heater 120 will not be energized and the thermal switch 116 will be made to be in its open state so as to stop the starting operation of the dishcarge lamp.

According to this embodiment, the independent holding heater 19 is provided separately from the main heater 118 so that, even if the bimetal gap is not made constant, a proper setting of the Zener voltage of the constant-voltage diode 149 will make it possible to keep the gap substantially constant during the lamp lighting as in the case of FIG. 5, simply by connecting another constant-voltage diode in parallel to the holding heater 119.

In FIG. 9*a*, there is shown a practical example of the thermal switch used in the foregoing embodiments, wherein main and auxiliary bimetal electrodes 217 and 217*a* are shown as bent somewhat exaggerately but, in practice, they are disposed to oppose each other substantially in parallel relation and are secured at the base portion respectively to each of terminal plates 223 and 223*a*, while free ends of the bimetals 217 and 217*a* are preferably made to approach one another, and these bimetal electrodes 217 and 217*a* are provided as secured to their free end respectively with each of contact members 222 and 222*a* which are normally closed but are capable of being opened. The main bimetal 217 is further provided, in the case of the thermal switch of, for example, FIG. 5, with a main heater 218 and holding heater 219, while the auxiliary bimetal 217*a* is provided with an auxiliary heater 220. As shown in FIG. 10, the heaters 218, 219 and 220 respectively comprise electrode plates 224 and 224*a* to which lead wires 225 and 225*a* are connected, an electrically resistive film 226 interposed between the plates, and a base 227 of such ceramic material as almina ceramic or the like on which the electrode plates and film are mounted. The heaters may be secured to the respective electrodes either by means of an adhesive or any mechanical measure.

A thermal switch 316 shown in FIG. 9*b* has the same structure as that in FIG. 9*a* in respect of main and auxiliary bimetal electrodes 317 and 317*a* carrying contact members 322 and 322*a* and secured to terminal plates 323 and 323*a*, except that the bimetal electrodes are made of a magnetic material. In the present instance, the main electrode 317 is wound with a main heater 328 comprising a coil resistor of, for example, a manganin wire coated with an electrically insulative film so as to provide a magnetic flux $\phi_1$, while the auxiliary bimetal electrode 317*a* is wound with a coil 328*a* of a low resistive conductive material having an electrically insulative film so as to provide a magnetic flux $\phi_2$, with the same number of turns as the main heater 328 and connected to the main heater. Further, a holding heater 319 is formed by applying an insulative film on the main electrode 317, further printing a thick resistive film and providing a pair of electrodes onto the both sides. Further, an auxiliary heater 320 similar to that of FIG. 10 is employed as secured onto the auxiliary bimetal electrode 317*a*.

When the thermal switch of FIG. 9*b* is used in the circuit of FIG. 5, such a preheating current which is half-wave rectified as shown by I of FIG. 11 is fed to the main heater 328 to heat the main bimetal electrode 317. Under this condition, if the thermal switch would be caused to open during the time period $t_o$–$t_1$ in which no preheating current flows, that is, no current is fed to the stabilizer, the kick voltage by means of the stabilizer would not be generated and thus the lamp lighting would not take place. In the present thermal switch, however, as soon as the main heater 328 is supplied with a current, the magnetic flux is generated in the directions shown by symbols $\Phi_1$ and $\Phi_2$ in FIG. 9*b* so that a magnetic repulsion force proportional to the square value of such a fed current amount as shown by II in FIG. 11 is generated substantially as aligned in the phase with the preheating current, more reliably than in the case of FIG. 9*a* in which a magnetic repulsion is also generated. On the other hand, as the temperature of the main electrode 317 rises a mutual contacting pressure between the bimetal electrodes 317 and 317*a* will vary as shown by a curve P' in FIG. 12 but, as the magnetic repulsion force is squared as shown by II in FIG. 11, the contact pressure is caused to vary as aligned in phase with the half-wave rectified waveform (during the time period $t_1$–$t_5$ in FIG. 11) of the preheating current as shown by a curve P in FIG. 12, so that the contact pressure level immediately before the opening of the switch will drop to the level shown by P in II of FIG. 11 so that the maximum value of the magnetic repulsion force will become considerably larger. As a result, it will be readily appreciated by those skilled in the art that the phase of the mechanical switch opening operation, that is, the arc generating phase may be aligned, as shown by a probability distribution in III of FIG. 11, with the time period $t_2$–$t_3$ in which the magnetic repulsion force exceeds the contact pressure level P in II of FIG. 11, and that the electrical opening phase, that is, the arc distinguishing phase will concentrate to a phase range in which the current flowing during a time before the time $t_3$ over to the time $t_4$ prior to the terminating time $t_5$ of the half wave of the preheating current, as will be clear from a probability distribution in IV of FIG. 11, so that the wave height of the kick voltage can be stabilized and, generally, the starting failure will be prevented so as to enable it possible to light the discharge lamp with a single starting operation.

In the respective embodiments referred to above, the main heater is caused to be energized by the current flowing through the switching means, while the holding heater (when the main heater also acts as the holding heater as in FIGS. 3 and 6, then the main heater functioning as the holding heater) is to be energized by the current flowing through the circuit element parallel to the switching means. In this case, the current flowing the switching means is substantially the preheating current. It will be also clear for any skilled in the art that the circuit parallel to the switching means also includes, for example, the discharge lamp 32 in the case of FIG. 3 and this lamp forms an electric valve means or the like.

According to the present invention arranged as has been disclosed in the foregoings such remarkable effects can be achieved that the immediate discharge lamp lighting ability can be ensured with inexpensive and compact arrangements, any deterioration in the starting ability due to variations in the ambient temperature can be prevented, the starting operation can be restrained so as to protect componential members of the device when the discharge lamp reaches the end of its service life, a reliable lamp lighting can be well realized with a single starting operation, and so on.

What we claim as our invention is:

1. A discharge lamp starting device comprising an alternating current source for energizing a discharge lamp, a current limiting means connected to a circuit on the side of said source with respect to said lamp and including at least an inductive element, a normally closed switching means connected to a circuit on the other side of the lamp and including main and auxiliary bimetal electrodes thermally bendable in the same direction, a main heating means to be energized by a current flowing through said switching means for opening said main bimetal electrode from said auxiliary bimetal electrode; a holding heating means to be energized by a current flowing through a circuit element parallel to the switching means for holding an open state of the switching means, means for detecting non-lighting state of the lamp under an application of source current to provide an output, and an auxiliary heating means to be energized by said output for driving the auxiliary bimetal electrode toward the main electrode to close the switching means.

2. A device according to claim 1 wherein said main and holding heating means comprise a single heating member, and said current for energizing said single heating member as the holding heating means to hold said open state of said switching means is relatively smaller than said current for opening said main bimetal electrode.

3. A device according to claim 1 wherein said circuit element parallel to said switching means includes a valve means which is electrically opened upon said non-lighting state of said discharge lamp.

4. A device according to claim 1 wherein said non-lighting state detecting means is a voltage detecting means which provides said output when a voltage across said discharge lamp exceeds a predetermined value larger than the discharging voltage.

5. A device according to claim 4 therein said voltage detecting means includes a constant-voltage element having a constant-voltage value set close to a value corresponding to the minimum effective value of the discharge lamp lighting voltage which varying depending on the ambient temperature, and said constant-voltage element provides an output for energizing said auxiliary heating means to have the position of said auxiliary bimetal electrode varied by a positional variation of said main bimetal electrode responsive to the ambient temperature.

* * * * *